US006334391B1

(12) United States Patent
Rea et al.

(10) Patent No.: US 6,334,391 B1
(45) Date of Patent: Jan. 1, 2002

(54) INK CARTRIDGE VALVE SYSTEM

(75) Inventors: Keith R. Rea; Patrick B. Keese, both of Florence, SC (US)

(73) Assignee: Sonoco Development, Inc., Hartsville, SC (US)

( * ) Notice: Subject to any disclaimer, the term of this patent is extended or adjusted under 35 U.S.C. 154(b) by 0 days.

(21) Appl. No.: 09/677,432

(22) Filed: Oct. 2, 2000

(51) Int. Cl.[7] ..... B41F 31/08; B41F 31/02
(52) U.S. Cl. ..... 101/366; 101/364
(58) Field of Search ..... 101/366, 364, 101/365, 210; 347/85, 86

(56) References Cited

U.S. PATENT DOCUMENTS

| | | | | |
|---|---|---|---|---|
| 2,855,130 A | | 10/1958 | Hosler | |
| 3,071,294 A | | 1/1963 | Galbierz | |
| 4,061,085 A | * | 12/1977 | Farrow | 101/366 |
| 4,066,014 A | | 1/1978 | van Haaften | |
| 4,183,031 A | * | 1/1980 | Kyser et al. | 101/366 |
| 4,432,473 A | | 2/1984 | MacEwen | |
| 5,348,196 A | | 9/1994 | Smith et al. | |
| 5,934,344 A | | 8/1999 | Wainberg et al. | |
| 5,974,971 A | | 11/1999 | Möller et al. | |
| 6,085,652 A | * | 7/2000 | Deschner et al. | 101/366 |
| 6,192,797 B1 | * | 2/2001 | Rea et al. | 101/202 |

FOREIGN PATENT DOCUMENTS

| | | | |
|---|---|---|---|
| DE | 0 690 815 B1 | | 12/1996 |
| DE | 197 05 201 C1 | | 4/1998 |
| JP | 10-217430 A | * | 8/1998 |

* cited by examiner

*Primary Examiner*—Daniel J. Colilla
(74) *Attorney, Agent, or Firm*—Bullwinkel Partners, Ltd.

(57) ABSTRACT

An improved ink cartridge dispensing valve system for use with a printing press ink cartridge is provided. The valve system works on the same principle as a ball valve to automatically dispense ink when subjected to pressure. The valve system includes an attachment post and an attachable nozzle. The attachment post is an integral part of the dispensing end of the ink cartridge and is recessed so that the cartridge can be easily shipped without damaging the attachment post. The attachable nozzle fits over the attachment post and opens or closes depending on whether pressure is placed on it by the ink in the cartridge.

5 Claims, 2 Drawing Sheets

INK CARTRIDGE VALVE SYSTEM

BACKGROUND

1. Field of the Invention

This patent relates to liquid dispensing cartridges for automated dispensing systems. More specifically, this patent relates to a dispensing valve system attachable to an ink cartridge that automatically opens and closes in response to pressure from the ink.

2. Description of the Related Art

Lithography is a printmaking process dating back to the 1700s in which ink is applied to a plate having both image and non-image areas. The image areas are ink-receptive and water-repellent. The non-image areas are water-receptive and ink-repellent. In rotary type lithographic presses the ink plate is mounted on a cylinder that rotates during printing. In one typical configuration, the plate cylinder picks up the ink at the image areas and transfers the image to a blanket cylinder which then transfers the image to the paper.

In multi-color sheet-fed presses, up to ten inking stations can be placed in series. Each station has its own ink feeding system and handles a separate color. As the paper sheet moves from station to station, a new color is put down at each station.

Because lithographic ink is thixotropic, conventional lithographic ink feeding systems require a complex system of drums, vibrators and fountain rollers. In a typical lithographic ink feeding system, workers remove lithographic ink from a drum (or, in some cases, smaller tins) with specially made spatulas and spread the ink across a tray (the ink fountain). Fountain rollers roll against the ink fountain to pick up the ink and transfer it to the plate cylinder. The process is labor intensive and subject to error.

Storing lithographic ink in drums can result in wasted ink if the entire drum is not used because it is difficult to store and reuse ink in drums. The lithographic ink itself is prone to oxidation which can result in color variations from one press run to another, and even from sheet to sheet within a single run. In addition, upon exposure of the ink to the atmosphere, volatile organic compounds (VOCs) evaporate, which can cause ink spoilage.

Consequently, many modern printers, including sheet fed lithographic printers, use smaller cartridges to dispense ink. During printing the ink cartridge moves back and forth across the fountain, dispensing ink into the fountain or directly onto an ink form roller to provide an even, consistent layer of ink. In automated presses, the amount of ink in the fountain is continually monitored and replenished as needed.

Ink cartridges can be easily filled, transported, used and reused. The cartridge minimizes exposure of the ink to the atmosphere and also minimizes the amount of residual ink left in the cartridge after use. The cartridge typically comprises a hollow cylindrical body, a plunger at one end and a dispensing fitment at the opposite end. The cylindrical body is filled with ink. The plunger serves as a piston within the cylindrical body to extrude the contents of the dispenser when the plunger is forced toward the dispensing end by, for example, pneumatic pressure.

The dispensing fitment is mounted in sealing engagement within the dispensing end of the cylindrical body and has a valve and nozzle for controlling the flow of ink. In one ink cartridge described in U.S. application Ser. No. 09/470,747, now U.S. Pat. No. 6,192,797 owned by the assignee of the present application, the valve is recessed below the edge of the cartridge and the nozzle extension is detachable so that the valve and nozzle extension do not become damaged during shipment. When ready to use at the printing plant, the nozzle extension is attached to the recessed valve and extends beyond the end of the cylindrical body. The valve must be manually opened to allow ink to flow.

While this type of dispensing cartridge is suitable for its particular purpose, it requires that the valve be manually opened and closed. Thus there exists a need for an improved ink cartridge dispensing valve system that operates in response to pressure from the ink to open and close.

Therefore it is an object of the present invention to provide an ink cartridge dispensing valve system that opens and closes in response to pressure from the ink.

Another object of the present invention is to provide an ink cartridge dispensing valve system that can be attached to a recessed universal attachment post at the printing press.

A further object of the present invention is to provide an attachable dispensing valve that can be used in a sheet fed lithographic printing press with a hand gun or with an automated printing system.

Still another object of the present invention is to provide an ink cartridge dispensing valve system that minimizes exposure of the ink to the atmosphere.

Yet another object of the present invention is to provide an ink cartridge dispensing valve system having a recessed universal attachment post for easy packing, shipping and storing.

Further and additional objects will appear from the description, accompanying drawings, and appended claims.

SUMMARY OF THE INVENTION

The present invention is an improved ink cartridge of the type used to dispense ink in automatic lithographic presses. The ink cartridge comprises a hollow cylindrical body for holding a supply of extrudable ink and has a dispensing end and a plunger end. The plunger end is closed by a plunger adapted to serve as a piston within the cylindrical body to extrude the contents of the dispenser when the plunger is forced toward the dispensing end by pneumatic or mechanical pressure. The dispensing end is closed by a dispensing fitment affixed thereto by glue or other suitable means. The improvement comprises an attachment post mounted over a central aperture in the dispensing fitment, the attachment post having a sidewall and a top wall, the top wall having a plurality of openings therein; a nozzle mounted over the attachment post and defining a substantially cylindrical space; a plate mounted within the substantially cylindrical space, the plate having a central opening; and a spring mounted within the substantially cylindrical space on the side of the plate away from the attachment post top wall to bias the plate in sealing engagement with the attachment post top wall. When pressure is exerted on the plate by the ink, the spring compresses, allowing ink to be extruded through the nozzle.

THE DRAWINGS

DETAILED DESCRIPTION OF THE INVENTION

Figure 1:
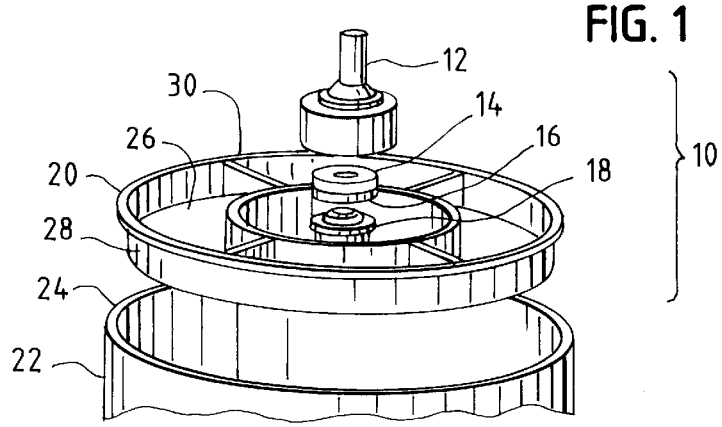
FIG. 1 is an exploded perspective view of an ink cartridge dispensing system according to the present invention.

Turning to the drawings, there is shown in FIG. 1 an exploded view of an ink cartridge dispensing system 10 made according to the present invention for use with a sheet fed lithographic press. The ink cartridge dispensing system 10 comprises a nozzle 12, a spring 14, an annular plate 16 and an attachment post 18. The attachment post 18 may be formed as an integral part of the dispensing fitment 20.

The dispensing fitment 20 is mounted in sealing engagement with the top end of the cartridge body 22. The dispensing fitment 20 may be glued to the cartridge body 22 or attached by any other suitable means. The top end of the cartridge body 22 terminates in a rim or edge 24.

Preferably, the cartridge body 22 is made of convolutely wound paper lined internally with polymeric material, although any suitable materials may be used, including, depending on the application, metal or plastic. In the preferred embodiment the dispensing fitment 20, attachment post 18 and nozzle 12 are made of plastic. In practice, the cartridge body 22 typically is about nine or thirteen inches long, but any suitable length may be used depending on need.

In automated lithographic printing presses, the ink cartridge is mounted in an inverted position within a cartridge carriage (not shown). During operation, the carriage moves laterally along the length of a fountain roller while an ink level sensor constantly monitors the amount of ink in the fountain roller to determine the exact locations where ink is needed. When a low level of ink is detected by the sensor, the controller activates an air supply which forces air against a pneumatically controlled plunger slidingly engaged within the cartridge, which then forces ink onto the fountain roller. The ink cartridge dispensing system 10 of the present invention was specifically designed to work with automated ink dispensing systems of the type just described.

The dispensing fitment 20 is generally cup-shaped and comprises a substantially circular disk 26 and an annular sidewall 28 formed around the periphery of the disk 26 and extending upwardly therefrom (upward being defined as the direction away from the bottom or plunger end). An aperture is located at the center of the circular disk 26 through which ink may flow. A closure flange 30 extends radially outwardly from the top end of the annular sidewall 28. When the dispensing fitment 20 is fully inserted into the cylindrical body 22, the closure flange 30 abuts the rim 24 of the cylindrical body 22 to prevent further insertion of the dispensing fitment 20.

Figure 2:
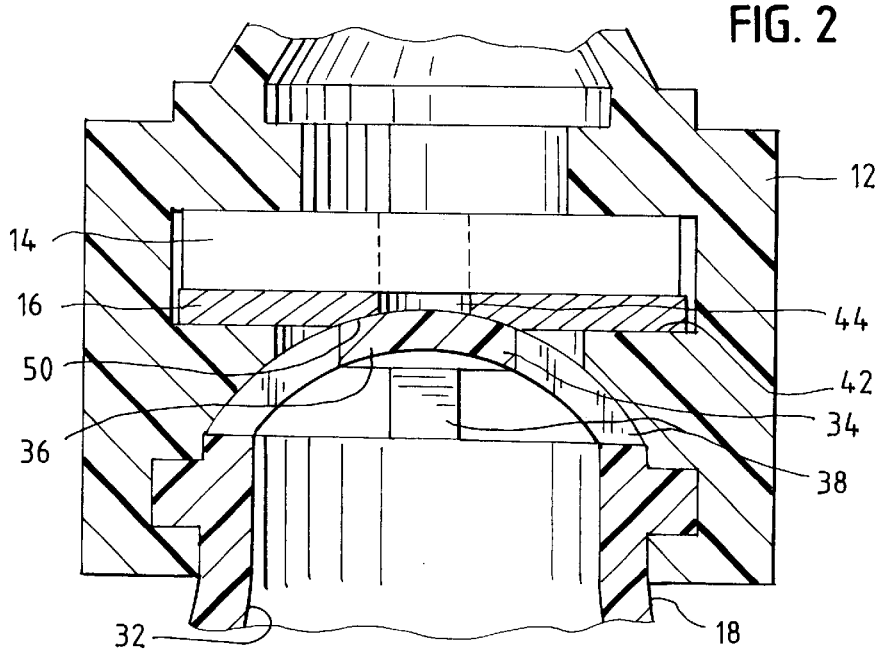
FIG. 2 is a cross-sectional view of the ink cartridge dispensing system of FIG. 1 shown in the closed position.
Figure 3:
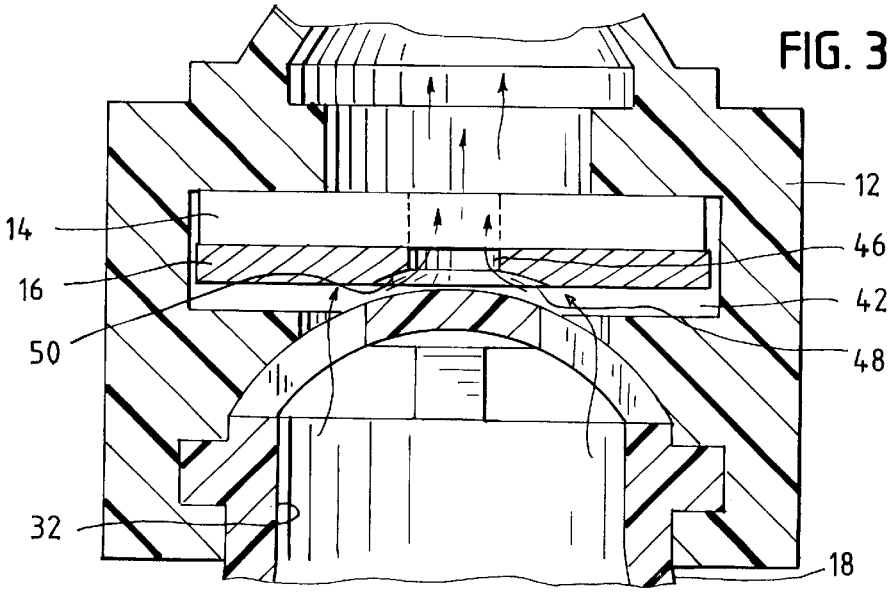
FIG. 3 is a cross-sectional view of the ink cartridge dispensing system of FIG. 1 shown in the open position.
Figure 4:
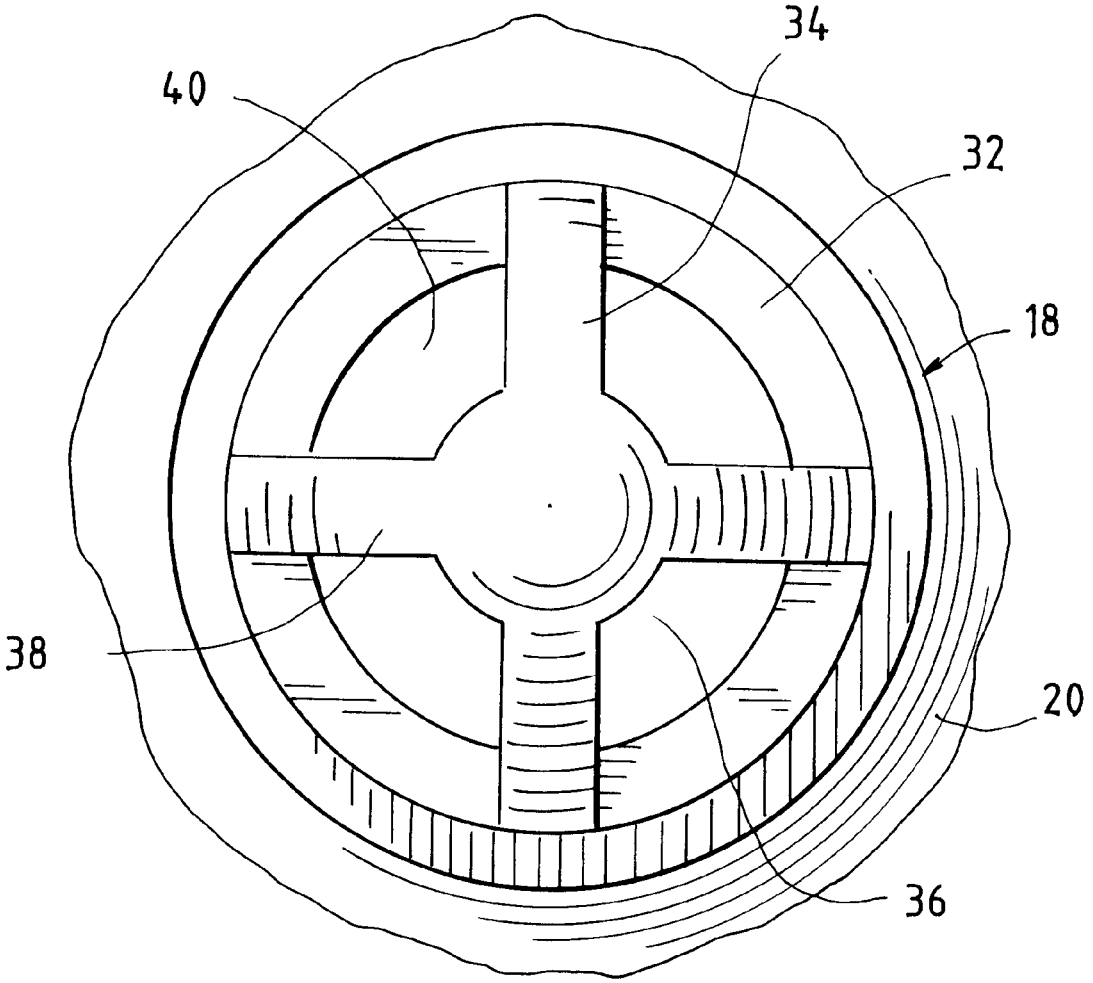
FIG. 4 is a top plan view of the attachment post of the ink cartridge dispensing system of FIG. 1.

The attachment post 18 is mounted on the circular disk 26 over the central aperture. As shown in FIGS. 2 and 3, the attachment post 18 has a substantially cylindrical sidewall 32 extending upwardly from the perimeter of the circular aperture and a convex top wall 34. As best seen in when viewed from above (FIG. 4), the convex top wall 34 comprises a top plug 36 centrally disposed over the circular disk aperture and connected to the sidewall 32 by four arcuate bridges 38. The top plug 36, bridges 38 and sidewall 32 define four openings 40 through which the ink can flow when the dispensing system 10 is in the open position.

Referring to FIGS. 2 and 3, the nozzle 12 fits over the attachment post 18 in fixed relationship thereto. In the illustrated embodiment, the nozzle 12 is screwed upon the externally threaded sidewall 32, although any suitable means of attachment will suffice.

The spring 14 and the annular plate 16 are disposed within the nozzle 12 in a cylindrical space 42 above the attachment post 18. The plate 16 has a centrally disposed hole 44 through which ink may flow. The plate 16 is made of a material that is impervious to ink, such as polyethylene. In the preferred embodiment shown in FIG. 3, the hole 44 has a cylindrical portion 46 and a concave portion 48. The upper wall 50 of the concave portion 48 mates with the convex top wall 34 of the attachment post 18 to form a seal when the dispensing system is in the CLOSED position (FIG. 2).

The spring 14 also has a hole in the middle and/or is pervious to ink. The spring 14 is compressible and resilient, and serves to bias the plate 16 against the attachment post 18 to seal off the flow of ink.

The CLOSED position of the dispensing system 10 is shown in FIG. 2. The spring 14 is expanded so that the spring 14 and plate 16 fill the cylindrical space 42 within the nozzle 12. The spring 14 biases the plate 16 against the attachment post 18. In this position, the plate 16 is seated against the plug 36 to seal off the channel 44 through the plate 16. Ink cannot flow through the nozzle.

The OPEN position of the dispensing system is shown in FIG. 3. When pressure from the ink impinges on the dispensing system 10, the spring 14 compresses and the plate 16 disengages the attachment post top wall 34. Ink then flows through the openings 40 in the attachment post top wall 34 and through the nozzle 12.

Thus the present invention provides a dispensing system for an ink cartridge having a spring loaded plate 18. The cartridge automatically dispenses ink when the plunger end is depressed, forcing ink through the nozzle. The present invention is particularly suitable as an ink dispenser for use with a sheet fed lithographic press having an automatic ink level sensor.

Other modifications and alternative embodiments of the invention are contemplated which do not depart from the spirit and scope of the invention as defined by the foregoing teachings and appended claims. For example, it is contemplated that attachment post top wall may be flat or some other suitable shape. It is intended that the claims cover all such modifications that fall within their scope.

We claim as our invention:

1. In an ink cartridge comprising a hollow cylindrical body for holding a supply of extrudable ink, the cylindrical body having a dispensing end and a plunger end, the plunger end being closed by a plunger adapted to serve as a piston within the cylindrical body to extrude the contents of the dispenser when the plunger is forced toward the dispensing end, the dispensing end being closed by a dispensing fitment affixed thereto, the improvement comprising:

an attachment post mounted over a central aperture in the dispensing fitment, said attachment post having a sidewall and a top wall, said top wall having a plurality of openings therein;

a nozzle mounted over the attachment post, said nozzle defining a substantially cylindrical space;

a plate mounted within the substantially cylindrical space, said plate having a central opening; and a spring mounted within the substantially cylindrical space on the side of the plate away from the attachment post top wall, said spring biasing the plate in sealing engagement with the attachment post top wall;

wherein pressure exerted on the plate by the ink causes ink to be extruded through the nozzle.

2. The dispensing system of claim 1 wherein the top wall is convex and the plate has a concave surface that engages the top wall in sealing relationship when the plate is biased against the top wall.

3. The dispensing system of claim 1 wherein the spring is pervious to ink.

4. The dispensing system of claim 1 wherein the spring has a central opening.

5. The dispensing system of claim 1 wherein the top wall of the attachment post comprises a plug centrally disposed over the aperture in the dispensing fitment and connected to the sidewall by arcuate bridges.

* * * * *